United States Patent [19]

Oldroyd

[11] Patent Number: 5,031,316

[45] Date of Patent: Jul. 16, 1991

[54] SAFETY RAZORS

[75] Inventor: Brian Oldroyd, Reading, England

[73] Assignee: The Gillette Company, Boston, Mass.

[21] Appl. No.: 458,655

[22] PCT Filed: Jul. 18, 1988

[86] PCT No.: PCT/US88/02431

§ 371 Date: Jan. 30, 1990

§ 102(e) Date: Jan. 30, 1990

[87] PCT Pub. No.: WO89/00487

PCT Pub. Date: Jan. 26, 1989

[30] Foreign Application Priority Data

Jul. 21, 1987 [GB] United Kingdom ..... 8717216

[51] Int. Cl.[5] ..... B26B 21/00

[52] U.S. Cl. ..... 30/47; 30/49

[58] Field of Search ..... 30/47, 49, 50, 81, 87

[56] References Cited

U.S. PATENT DOCUMENTS

| | | | |
|---|---|---|---|
| 4,227,302 | 10/1980 | Torrance | 30/47 |
| 4,443,939 | 4/1984 | Motta et al. . | |
| 4,459,744 | 7/1984 | Esnard . | |
| 4,516,320 | 5/1985 | Peleckis . | |
| 4,720,917 | 1/1988 | Solow . | |
| 4,754,548 | 7/1988 | Solow . | |
| 4,866,844 | 9/1989 | Burout, III | 30/47 X |

*Primary Examiner*—Timothy V. Eley
*Assistant Examiner*—Willmon Fridie, Jr.
*Attorney, Agent, or Firm*—Lorusso & Loud

[57] ABSTRACT

A razor including an elongated handle and a blade unit at one end thereof and extending transversely thereto. The blade unit is flexibly mounted on the handle and is anchored toward each end to permit the center region to bow inwardly and outwardly.

10 Claims, 3 Drawing Sheets

SAFETY RAZORS

This invention relates to safety razors comprising a flexible razor blade unit secured to a handle by connecting means arranged to permit free flexure of the unit in use of the razor.

The blade unit is readily flexible in response to forces encountered during normal use, about an axis, or axes, parallel with the plane of the blade (or blades) and extending substantially perpendicular to the cutting edge (or edges) thereof.

The present invention is particularly concerned with means by which such a unit is connected to a razor handle so as to be adequately supported and guided thereon, whilst permitting the required flexure of the unit in use.

For convenience of description, the blade unit will be assumed to be a tandem blade unit, having a pair of parallel blades whose respective cutting edges are held in spaced parallel relation, so as to act in tandem on the skin of a user.

In a preferred form of the invention, the connection means comprise slide means for mounting and guiding the blade unit for reciprocal movement relative to the handle in a direction substantially perpendicular to the planes of the blades, the slide means being located at the mid-length of the blade unit, and further connections, to either side of the slide means, permitting relative movement of opposite end portions of the blade unit, relative to the handle, in directions generally parallel with the blade edges.

With this arrangement, the slide means serve to centralise the blade unit longitudinally on the handle, whilst permitting free movement of the central part of the blade unit towards and away from the handle, and the further connections, which are conveniently formed as pin and slot connections permit concomitant movement of the opposite end portions of the blade unit towards and away from each other.

The invention will now be described in detail, by way of example, with reference to the accompanying drawings, in which.

Figure 3:
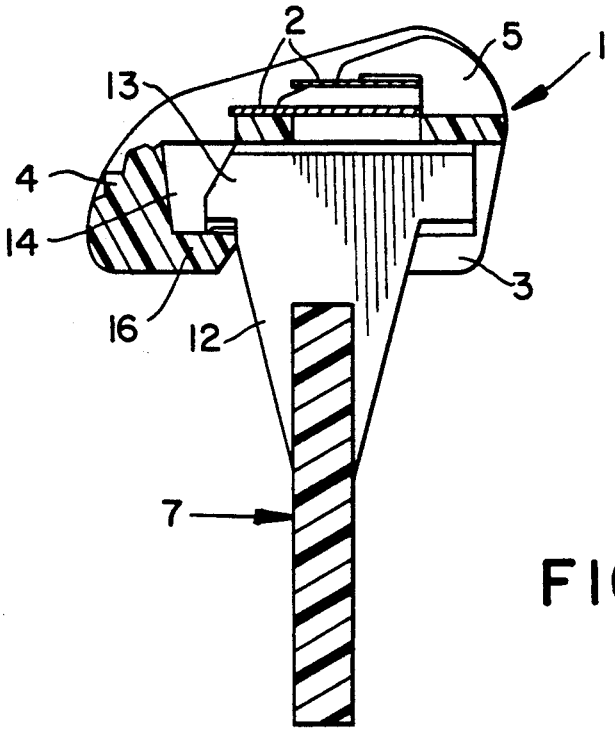
FIG. 3 is a cross-section of the assembled razor.

The illustrated razor comprises a flexible head or blade unit 1 including a tandem pair of wafer thin, single edged blades 2 (FIG. 3) separated by a spacer and set permanently in a highly flexible moulded plastics support structure 3 providing a comb-like skin guard 4 ahead of and below the blade edges and a segmented cap portion 5 overlying the blade pair.

Figure 1:
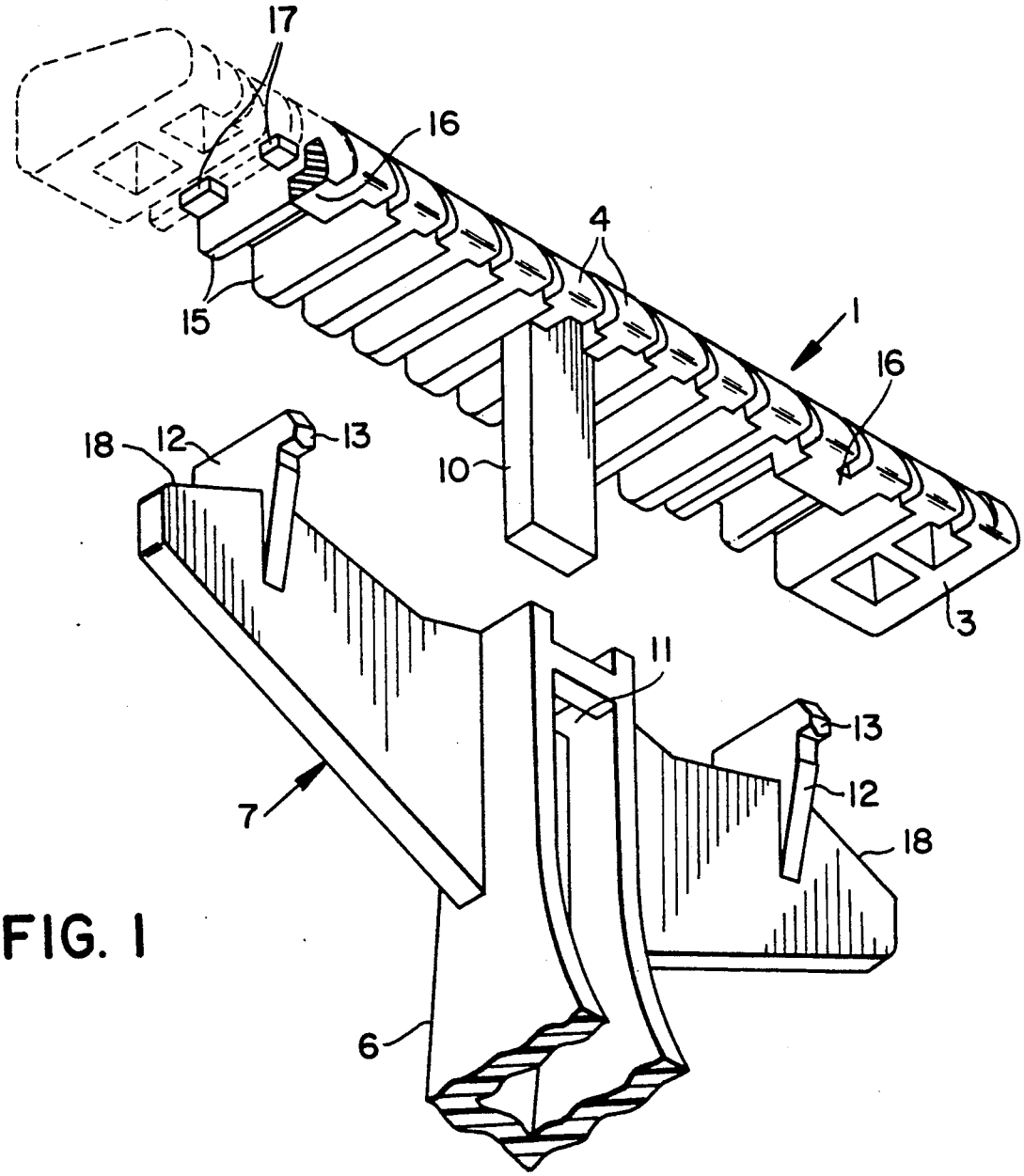
FIG. 1 is a perspective view, from below the handle and blade unit, both partly broken away, prior to assembly.
Figure 2:
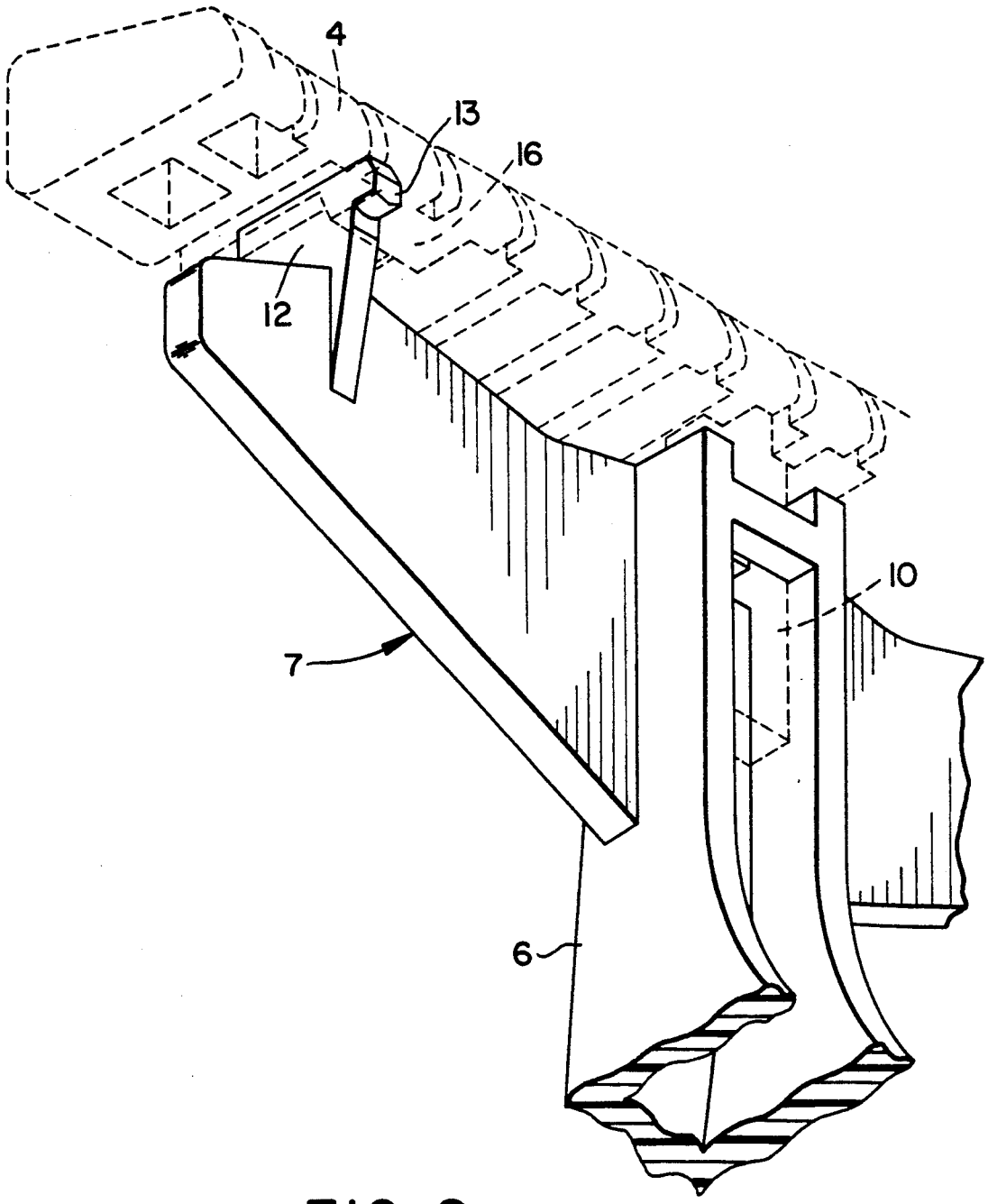
FIG. 2 is a perspective view from below the handle assembled with the blade unit, the blade unit being shown in phantom.

The razor handle is constituted by a unitary moulding of plastics material formed to provide an elongate grip portion 6 (FIGS. 1 and 2) and a generally plate-like handle upper portions 7 on which the blade unit 1 is mounted.

The connection means include a slide means comprising a central post 10 of rectangular cross-section, which depends from an underside of the blade unit and extends substantially perpendicular to the planes of the blades at the mid-length of the blade unit, and a socket 11 formed at the upper end of the handle. The socket is also of rectangular cross-section and is sized to receive the post 10 with an easy sliding fit.

With the post 10 located in the socket 11, the blade unit 1 is centralized longitudinally relative to the handle and restrained from rotating about the handle, but is guided for easy sliding movement towards and away from the handle, in a direction lengthwise of the post 10.

The further connections are disposed to either side of the central post 10 and permit and constrain the opposite end portions of the unit to move, relative to the handle, towards and away from each other, generally parallel to the blade edges.

Each of the handle upper portion 7 is formed with a support leg 12 terminating at a forwardly projecting pin 13 of part rounded cross-section In the assembled razor, the pins 13 are located in and trapped by rearwardly facing pockets 14 (FIGS. 3 and 4) formed at the underside of the blade unit 1. The pockets 14 are conveniently formed between adjacent ribs 15 (FIGS. 1 and 4) of the support structure 3 and short bridging portions 16 interconnecting the ribs 15.

Figure 4:
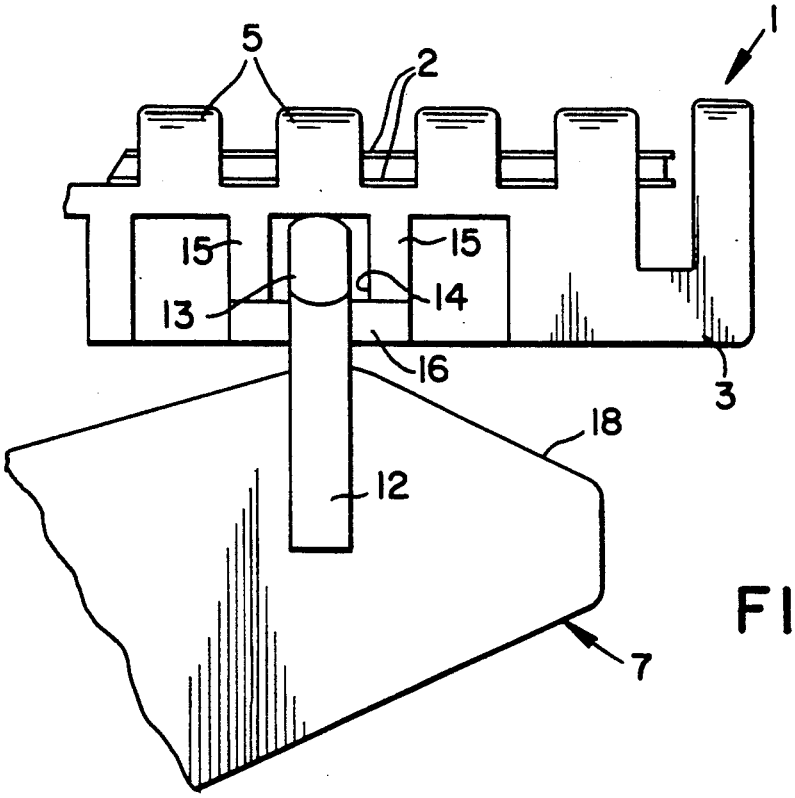
FIG. 4 is a rear view of a portion of the assembled razor.

As best seen in FIG. 4, the depth of each pocket 14 approximates the depth of the corresponding pin 13, whose upper and lower rounded edges are located against the upper and lower faces of the pocket 14. The width of the pocket is, however, greater than that of the pin 13 so as to permit movement of the pocket relative to the pin in directions generally parallel to the blade edges. Engagement of the pins 13 in the pockets 14 also retains the blade unit 1 against removal from the handle. The upper rounded edges of the support legs 12 and the pins 13 engage against the underside of webs 17 (FIG. 1) spanning adjacent ribs 15.

Initial assembly of the unit with the handle is readily effected by engaging the centre post 10 in the guide socket 11 and pressing the blade unit 1 towards the handle in the regions of the support legs 12, the pins 13 snapping into the pockets 14, thanks to the flexibility and resilience of the components. The illustrated razor is intended to be disposable, but the connection means illustrated may readily be modified for removal and replacement of the blade units on a permanent handle.

The blade unit is thus securely attached to the handle by connection means of very simple construction, but retains its high degree of flexibility, reduced only by very small frictional resistances to sliding between the components.

The support legs 12 are each set in from the ends of the blade unit, their spacing apart being approximately ⅔ of the length of the blade unit, so as to permit the blade unit to deflect convexly if one or both ends encounter larger forces in use than the medial section. The blade unit can, of course, deflect concavely if more force is encountered in the medial section.

In the concave mode, deflection of the blade unit is limited by abutment of the underside of the blade unit with an upper end of the central portion of the handle, and in the convex mode by the underside of the blade unit abutting upper edges 18 of outer ends of the handle upper portions 7.

In the particular embodiment illustrated, concave deflection is limited to 2.5 mm at the centre, and in the convex mode, deflection of the end portions of the unit is limited to 3 mm, both measured from the neutral, unstressed condition of the unit.

The main forces encountered during shaving are directed perpendicular to the planes of the blades, and pass through a region bordered by the cutting edges of the blades. For this reason, the post 10 is aligned with that region, so as to minimise any tendency for the post 10 to be subjected to any bending movements which would tend to cause it to bind in its pockets 11.

In the case of a single blade unit, the post is aligned with the cutting edge of the blade.

I claim:

1. A safety razor comprising a razor blade unit which is readily flexible, in response to forces encountered during normal use, about an axis parallel with a plane of a blade of said blade unit and extending substantially perpendicular to a cutting edge of said blade, a handle, and connecting means connecting said blade unit to said handle, said connecting means comprising slide means for mounting and guiding said blade unit for reciprocal movement relative to said handle in directions substantially perpendicular to said plane of said blade, said slide means comprising a post extending from an underside of said blade unit at the mid-length of said blade unit, and further connections to either side of said slide means cooperatively disposed on said handle and said blade unit, said further connections permitting movement of end portions of said blade unit relative to said handle in directions generally parallel to said blade cutting edge.

2. The safety razor according to claim 1, wherein said slide means comprises said post extending essentially perpendicular to said plane of said blade and received in a socket in said handle in which said post is slidably movable during a shaving operation.

3. The safety razor according to claim 2, wherein said post and said socket are of non-circular cross-section to prevent relative rotation therebetween.

4. The safety razor according to claim 3, wherein said further connections each comprise a pin mounted on said handle and disposed in a blade unit socket, said pin being adapted to slide sidewise in said socket in directions generally parallel with said blade edge, but constrained against substantial relative movement in directions perpendicular to said plane of said blade.

5. The safety razor according to claim 4, wherein said pins extend parallel with said axis and have rounded upper and lower edges to facilitate flexure of said blade unit about said axis.

6. A razor according to claim 4, wherein the said further connections are each set in from the ends of the blade unit and are spaced apart by a distance approximately one-third of the length of the unit.

7. A safety razor comprising a blade unit and a handle, said blade unit comprising blade means retained by support structure, said blade means and said support structure being flexible and adapted, during a shaving operation, to flex in directions perpendicular to a plane of said blade means, a post extending from an underside of said blade unit centrally of said blade unit, and pockets in said blade unit extending lengthwise of said blade unit, said pockets being disposed one each on opposite sides of said post, said handle comprising a grip portion and an upper portion, said upper portion having a socket centrally thereof with said post slidably disposed therein, and pins fixed to said upper portion and disposed each in one of said blade unit pockets and adapted for movement therein in directions generally parallel to a non-flexed cutting edge of said blade means, whereby said blade unit may flex in concave and convex directions relative to said plane of said blade means, and ends of said blade unit may move inwardly and outwardly in said directions generally parallel to said non-flexed cutting edge.

8. The safety razor in accordance with claim 7 in which said handle socket is defined by a handle central portion, and said concave flexure of said blade unit is limited by abutment of said blade unit underside with an end of said handle central portion.

9. The safety razor in accordance with claim 7 in which said upper portion of said handle includes plate-like handle portions, each having one of said pins mounted thereon, and said convex flexure of said blade unit is limited by said undersurface of said blade unit abutting edges of said plate-like handle portions.

10. The safety razor in accordance with claim 9 in which end portions of said plate-like handle portions are configured so as to be engaged by said undersurface of said blade unit upon deflection of end portions of said blade unit through a determined distance.

* * * * *